United States Patent [19]

Gregory, Jr.

[11] Patent Number: 4,977,714

[45] Date of Patent: Dec. 18, 1990

[54] ROOF VENTILATION BAFFLE

[76] Inventor: Stephen E. Gregory, Jr., 2951 Laurentide Dr., Ann Arbor, Mich. 48103

[21] Appl. No.: 243,411

[22] Filed: Sep. 12, 1988

[51] Int. Cl.[5] ..... E04B 1/74; E04D 13/16

[52] U.S. Cl. ..... 52/95; 52/199; 52/407; 98/37

[58] Field of Search ..... 52/404–407, 52/450, 95, 303, 199; 98/31, 37, DIG. 6

[56] References Cited

U.S. PATENT DOCUMENTS

| | | | |
|---|---|---|---|
| 709,257 | 9/1902 | Cottrell | 52/404 |
| 960,554 | 6/1916 | Jennings | 52/450 |
| 1,963,609 | 6/1934 | Balduf et al. | 52/407 |
| 3,797,180 | 3/1974 | Grange | 52/95 |
| 4,254,598 | 3/1981 | Rugroden | 52/95 |
| 4,446,661 | 5/1984 | Jonsson et al. | 52/407 |

FOREIGN PATENT DOCUMENTS

| | | | |
|---|---|---|---|
| 3623281 | 1/1988 | Fed. Rep. of Germany | 98/37 |

*Primary Examiner*—James L. Ridgill, Jr.
*Attorney, Agent, or Firm*—James M. Deimen

[57] ABSTRACT

A roof ventilation baffle comprising a pleated or corrugated membrane forming a plurality of air passages. The baffle is installed between the underside of the roof sheathing and the upper surface of fiberglass insulation bats with the pleats parallel to the rafters or roof joists to provide ventilation, along the underside of the roof sheathing. The ventilation baffle is also applicable to outside walls and floors over unheated or uncooled spaces. The baffle may be perforated to provide air flow between the air passages formed by the pleats and to permit any moisture trapped in the insulation to evaporate into and be removed by the air flow through the channels.

11 Claims, 2 Drawing Sheets

ROOF VENTILATION BAFFLE

BACKGROUND OF THE INVENTION

The field of the invention pertains to the ventilation of attics and roof undersides and, in particular, to roofs of wood frame construction having fiberglass bats inserted between the rafters of pitched roofs or the joists of substantially flat roofs.

In typical wood frame roof construction where the interior ceiling is attached to the rafters or joists and substantially follows the roof pitch, the insulation is placed between the rafters or joists. Thus, the insulation lies between the roof sheathing and the ceiling.

One of the most common, if not the most common insulation for wood frame roofs as well as steel frame roofs is fiberglass bats manufactured by such well known companies as Owens-Corning, Inc., Manville Corporation and Certainteed Corporation. The fiberglass fibers are very loose but randomly intermingled so as not to fall apart. A layer of paper or foil is attached to one or both sides of the fiberglass bat.

Before installation the fiberglass bats are tightly rolled or otherwise compressed to reduce bulk in shipment. Upon installation the bats greatly expand, normally filling the entire volume between the rafters or joists and between the ceiling and roof sheathing. As a result the fiberglass expands against the underside of the roof sheathing effectively preventing the movement of an air layer along the underside of the roof sheathing.

The prevention of air circulation along the underside of the roof sheathing has several detrimental effects. Under direct sunlight the roof sheathing temperature increases to a substantially higher temperature than otherwise thereby reducing the effectiveness of the fiberglass insulation.

Any moisture that collects under the roof sheathing in cold weather is retained in the fiberglass thereby reducing the insulating effectiveness of the fiberglass and also causing deterioration of the roof sheathing. Proper circulation of air beneath the roof sheathing can reduce the temperature extremes of the roof and substantially prevent the collection of moisture under the roof sheathing.

SUMMARY OF THE INVENTION

The invention comprises an easily installable inexpensive means of preventing the fiberglass insulation bats from expanding against the underside of the roof sheathing. Between the roof sheathing and the fiberglass is positioned a pleated membrane or baffle having the pleated strips extending parallel to the rafters or roof joists. The pleats are joined by integral longitudinal joints providing substantial lateral flexibility to the baffle. Integral fastening strips extend along the two longitudinal extremities of the baffle for attachment to the rafters or roof joists. Intermediate longitudinal fastening strips are also provided among the pleats for optional attachment to the underside of the roof sheathing. A plurality of perforations are formed in the baffle pleats to provide some lateral air circulation through the baffle and to permit any moisture that collects in the fiberglass to be evaporated and removed.

With standard underside vents at the eaves and vents at the roof peak normal changes in roof temperature and wind will cause the natural circulation of air longitudinally through the pleated baffle. Temperature extremes of the roof and moisture collection on the roof underside are thereby greatly reduced with the use of the pleated baffle.

In the case of a flat roof, wind passing over the roof will provide an air pressure differential across the opposite edges of the roof thereby causing some movement of air through the baffle along the underside of the roof.

Although the baffle is particularly directed to the ventilation of roof sheathing undersides, the baffle is applicable to outside walls and floors over unheated or uncooled spaces where ventilation is needed on the underside of the sheathing. Because the baffle pleated construction is easily expandable and contractable in the lateral direction, the baffle is particularly suited to irregular and non-standard roof construction such as that encountered in the retrofit of older residential homes. The baffles may be slid into position through slots cut into the roof or wall from the inside prior to blowing in loose fill insulation or stuffing with small fiberglass bats.

DESCRIPTION OF THE PREFERRED EMBODIMENT

Figure 1:
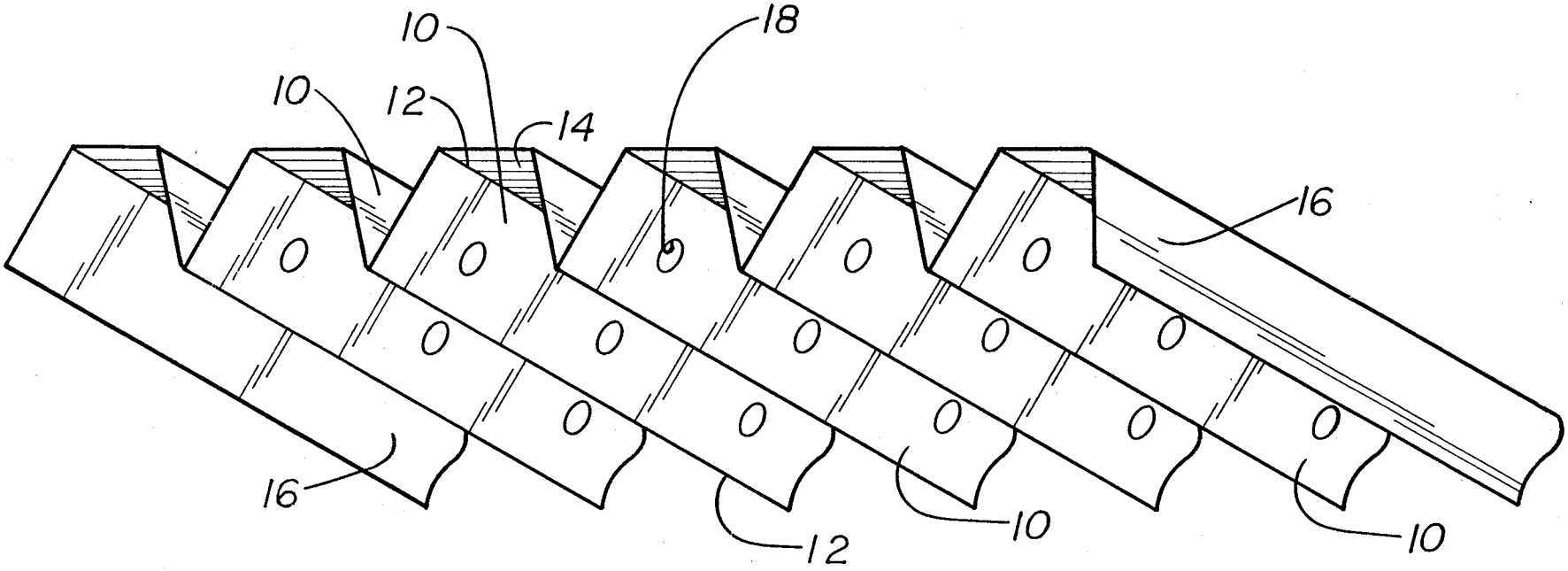
FIG. 1 is a cut away perspective view of the new baffle.

In FIG. 1 the pleated baffle comprises a plurality of strips 10 integrally joined longitudinally at 12 to form a pleated structure. The intermediate strips 14 that form a part of the integral structure are provided for ease of fastening to the underside of roof sheathing. Although the intermediate strips 14 are shown between each pair of downwardly extending strips 10, they need not be provided between every pair.

Along each longitudinal edge of the baffle an integral fastening strip 16 is provided for attachment to rafters or roof joists. Perforations 18 through the baffle are provided to permit circulation of air laterally between the longitudinal channels formed by the pleats.

The baffle may be manufactured from any suitable material that will provide sufficient rigidity to the strips 10 and sufficient flexibility of the joints 12. Thus, the baffle may be formed from thin metal, inexpensive polyethylene or polypropylene plastics or a heavy paper board or linear board material. Since the pleated construction provides for lateral expansion or contraction, the baffle may be formed flat and rolled flat for shipment. With scoring forming the joints 12 the baffle can be collapsed to the pleated shape shown in FIG. 1 on site just before installation.

As an alternative, the baffle can be constructed in a corrugated form smoothly curving upwardly and downwardly to form longitudinal passages for the circulation of air. Although not as convenient for shipment rolled up, the corrugated form can be shipped as stacked nested panels as can teh pleated form.

Figure 2:
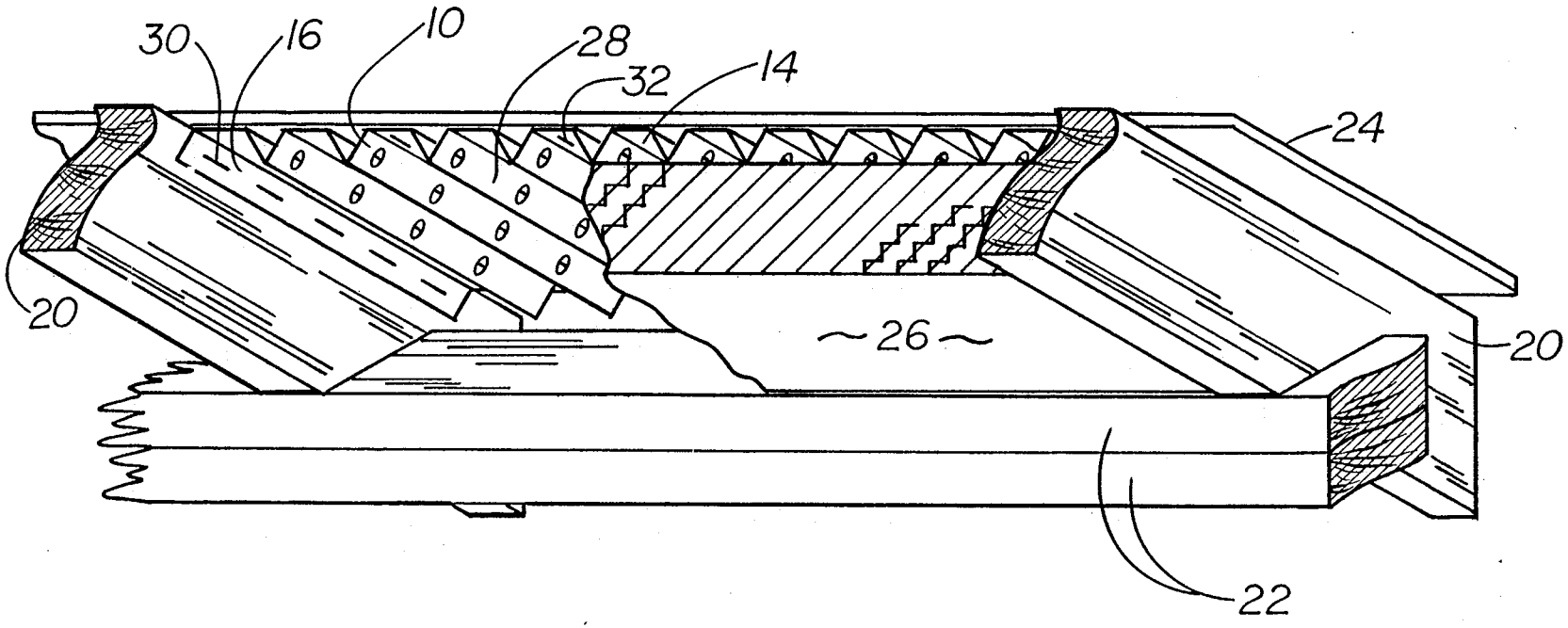
FIG. 2 is a cut away perspective view of the new baffle as installed.

In FIG. 2 the baffle is shown as installed in a pitched roof. The typical frame roof comprises parallel rafters 20 supported by a top plate 22. The rafters, 20 in turn support roof sheathing 24 typically of plywood or chip board. A fiberglass insulation bat 26 extends between the rafters 20 and upwardly from the top plate 22 toward the roof peak. The fiberglass bat 26 is typically stapled to the rafters by the paper selvage (not shown) along the longitudinal edges of the lower surface of the bat. The ceiling (not shown) is subsequently attached to the undersides of the rafters 20 thus enclosing the fiberglass bats 26.

The new baffle as indicated at 28 in FIG. 2 is installed from underneath prior to the installation of the fiberglass bat 26. Installation is most convenient by stapling the longitudinal fastening strips 16 to the rafters 20 as indicated at 30. The intermediate fastening strips 14 may also be stapled to the underside of the roof sheathing as indicated at 32. If stapling is not suitable, other fastening means such as construction adhesive may be used. The fiberglass bat 26 is then positioned below the baffle 28 and stapled to the rafters 20.

The lateral spacing between the pleats is preferably about two inches for rafters on 16 inch or 24 inch centers thereby effectively preventing the fiberglass from expanding up against the underside of the roof sheathing whether or not the fiberglass is paper covered on the upper surface of the fiberglass. The depth of the pleated baffle is preferably about one inch for good air flow although it may be less or more depending on the longitudinal length of the rafters.

I claim:

1. A pleated ventilation baffle comprising a plurality of longitudinal strips integrally joined longitudinally by flexible means to form a substantially pleated baffle extendable and contractable in the lateral direction, a plurality of ventilation holes in the longitudinal strips, and integral longitudinal strips at the lateral extremities of the baffle to form means for attachment to studs, joists or rafters.

2. A pleated ventilation baffle comprising a thin sheet having a plurality of longitudinal folds forming relatively flexible integral joints, said flexible integral joints providing substantial lateral expansion or contraction of the pleated baffle, a plurality of ventilation holes piercing the baffle, and the lateral extremities of the baffle terminating in longitudinal strips to form means for longitudinal attachment to a roof, wall or floor structure.

3. The pleated ventilation baffle of claim 2 including at least one intermediate longitudinal strip located between pleats and integrally forming a portion of the baffle between two longitudinal flexible joints, said intermediate longitudinal strip adapted to form means of attachment of the baffle to the structure.

4. A rood construction comprising parallel rafters with roof sheathing supported on said rafters, expandable insulation installed between said rafters and extending toward the roof sheathing, the improvement comprising a baffle located between the expandable insulation and the roof sheathing, said baffle comprising a plurality of pleats forming air passages separated by baffle strips extending parallel to the rafters, relatively flexible means integrally joining the strips together parallel to the rafters, a plurality of ventilation holes formed in the baffle strips, and fastening strips integrally joined to the pleats for attachment to the roof construction.

5. The roof construction of claim 4 wherein at least one of said fastening strips lies between pleated strips in the baffle and is fastened to the roof sheathing.

6. The roof construction of claim 4 wherein two of said fastening strips are located at the lateral edges of the baffle and fastened to rafters.

7. In a wall or floor construction comprising parallel studs or joists with sheathing attached thereto, expandable insulation installed between said studs or joists and extending toward the sheathing, the improvement comprising a baffle located between the expandable insulation and the sheathing, said baffle comprising a plurality of pleats forming air passages extending parallel to the studs or joists, said pleats including relatively flexible integral means to provide substantial flexibility in the lateral direction, a plurality of ventilation holes in the baffle and fastening strips integrally joined to at least two of the pleats for attachment to the studs, joists or sheathing.

8. The wall of floor construction of claim 7 wherein the pleating comprises corrugations in a substantially uniformly flexible material.

9. The construction of claim 7 wherein at least one of the fastening strips lies between pleats in the baffle and is fastened to the sheathing.

10. The construction of claim 7 wherein two of said fastening strips are located at the lateral edges of the baffle and fastened to studs or joists.

11. A pleated ventilation baffle comprising a thin flexible sheet folded to form corrugations thereby stiffening the sheet in the longitudinal direction and increasing the flexibility in the lateral direction, a plurality of ventilation holes in the baffle, and the baffle sheet terminating at the lateral extremes with two longitudinal strips that form means for longitudinal attachment to a structure.

* * * * *